United States Patent [19]

Underdown

[11] Patent Number: 4,955,362

[45] Date of Patent: Sep. 11, 1990

[54] LINER FOR FIREPLACE GRATE

[75] Inventor: Ronald W. Underdown, 735 So. Fairway, Fresno, Calif. 93727

[73] Assignee: Ronald W. Underdown, Fresno, Calif.

[21] Appl. No.: 247,071

[22] Filed: Sep. 21, 1988

[51] Int. Cl.[5] ..... F23H 13/00

[52] U.S. Cl. ..... 126/540; 126/152 B

[58] Field of Search ..... 126/164, 165, 163 A, 126/163 R, 152 R, 152 A, 152 B, 39 M, 500, 540

[56] References Cited

U.S. PATENT DOCUMENTS 3,505,986 4/1970 Wood ..... 126/165

4,008,703 2/1977 Allgood ..... 126/163 R

FOREIGN PATENT DOCUMENTS 1048880 2/1970 Canada ..... 126/163 R

*Primary Examiner*—James C. Yeung

*Attorney, Agent, or Firm*—James E. Toomey

[57] ABSTRACT

A product for use with a fireplace grate comprising a sheet of metal, preferably of mild steel, adapted to fit into a fireplace and cover the upper surface of the grate normally used therein. The sheet is bent upward at its long edges or otherwise formed so that the upper face thereof when laid flat on a grate is concave. The sheet has evenly spaced holes or apertures through its entire area to permit the free and uniform flow of air through it. The sheet is sufficiently strong to hold the fuel to be burned in the fireplace and is of a thickness, or gauge, sufficient to withstand premature destruction in use.

4 Claims, 1 Drawing Sheet

LINER FOR FIREPLACE GRATE

SUMMARY AND BACKGROUND OF THE INVENTION

This invention comprises a liner for a fireplace grate comprising a single sheet of steel of generally rectangular shape, having a concave cross-section along its length when placed on a grate and facing upwardly. The sheet has a plurality of uniformly spaced apart holes across the length and width thereof. The gauge or thickness of the sheet is sufficient to bear the weight of fuel to be placed thereon and to resist premature destruction from the ravages of use. The size and number of holes in the sheet are sufficient to enable efficient burning of logs and other materials.

The grate of this invention has several advantages in that it is placed on top of a fireplace grate so that the apertures in the sheet function as draft control units to permit the natural flow of air through the sheet to pass over the fuel while retaining the live embers to thereby maximize the heating value of the fuel. In short, the live embers directly under the fuel act as part of a positive thermal enhancer that is activated by a flow of air through the unit. This is in contrast to a conventional fireplace grate wherein the draft of air enters the fire box in an uncontrolled volume and flows over the fire and upward causing a greater portion of thermal energy to exit through the chimney.

The essential feature of this invention is the use of a metal liner, preferably mild steel, for placement on a grate to assist in the burning of fuel. Although the general concept has been proposed heretofore, none of the prior art devices have functioned to provide the efficiency and other advantages of the liner of the present invention. One example of a prior art liner is shown in U.S. Pat. No. 3,536,057 to Grosso. It comprises a generally U-shaped screen of a rectangular configuration supported by a fireplace grate or the like. The screen comprises woven wires which are spaced between about ⅛ to ⅜ of an inch apart. The wire is an iron alloy intended to resist sagging and other damage resulting from exposure to high temperatures. The woven screen is made and shaped in arcuate fashion and of generally rectangular configuration along its length. However, the relatively large openings between wires does not permit the ashes and embers to be properly retained in the fireplace, and the advantages of a controlled flow of air are not realized. Also, the wires do not hold up over a continued period of use that would permit such a device to function over an extended period of time. Frequent replacement is necessary.

Another example in the prior art is U.S. Pat. No. 1,823,576 to Stieqlitz which discloses a perforated flat fuel supporting plate for separating the ash pit section and the fire box section of a conventional furnace. It does not disclose or relate to a fireplace for producing heat.

A still further design is disclosed in U.S. Pat. No. 3,505,986 to Wood of 1970 which shows a steel plate of arcuate shape with specially designed apertures to enable metal rods to be placed in an upstanding position at specified locations on the plate. The rods are placed in the apertures to hold wooden logs which are loaded at selected points on the arcuate plate. Although the rods are intended to hold fuel such as logs in a manner that is intended to provide certain advantages with respect to combustion of logs and the like, the apertures fail to provide the draft of air necessary to promote combustion. Such an arrangement thus fails to recognize the great advantages to be achieved by retaining the embers of the coals or logs on the arcuate flat surface of a fully perforated sheet as in the case of the present invention. In fact it does not disclose a fully perforated sheet, and the type of apertures disclosed are such that they are easily clogged and thus fail to promote the flow of air through the sheet.

DETAILED DESCRIPTION OF THE PREFERRED EMBODIMENT

Figure 1:
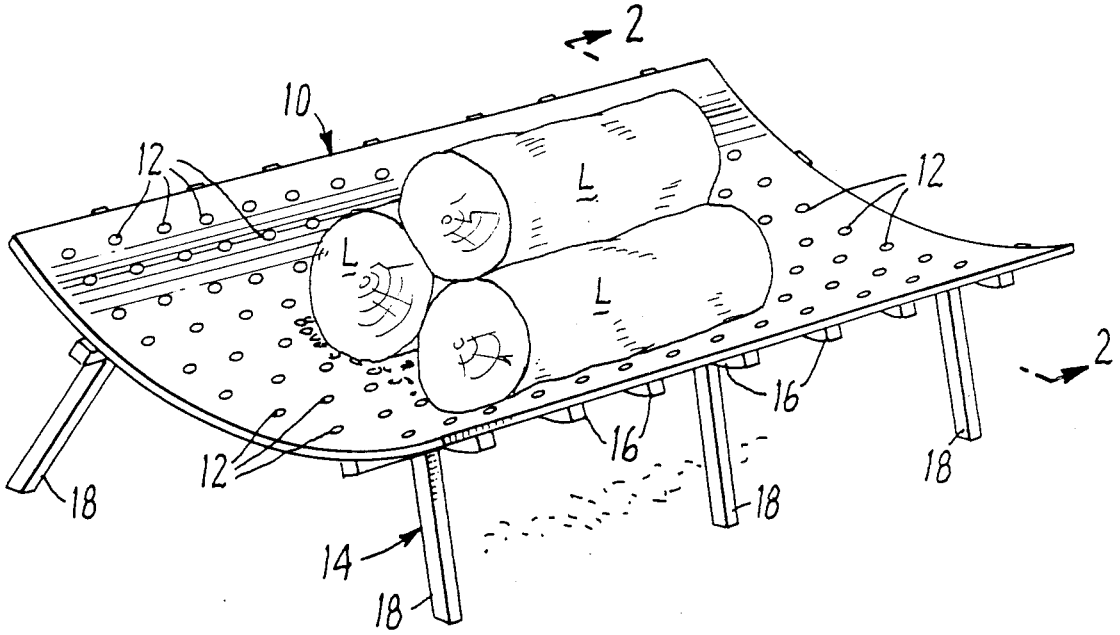
Figure 2:
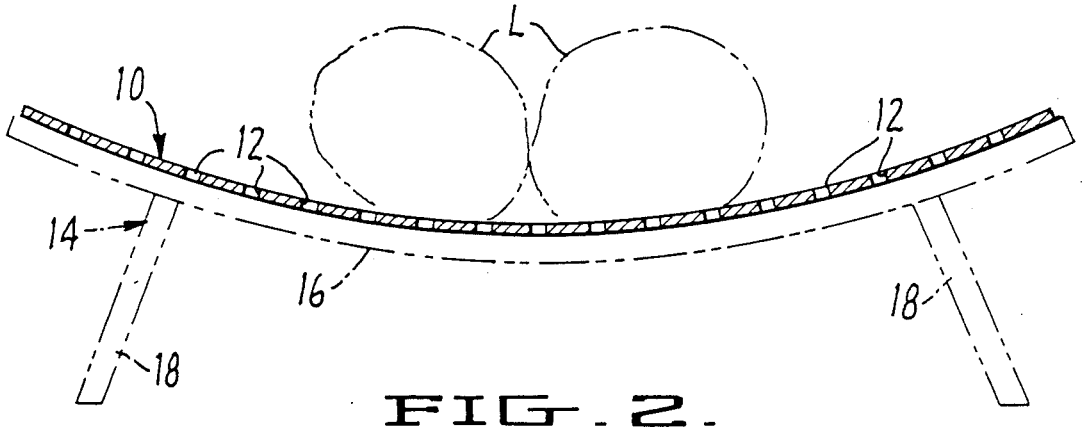
Figure 3:
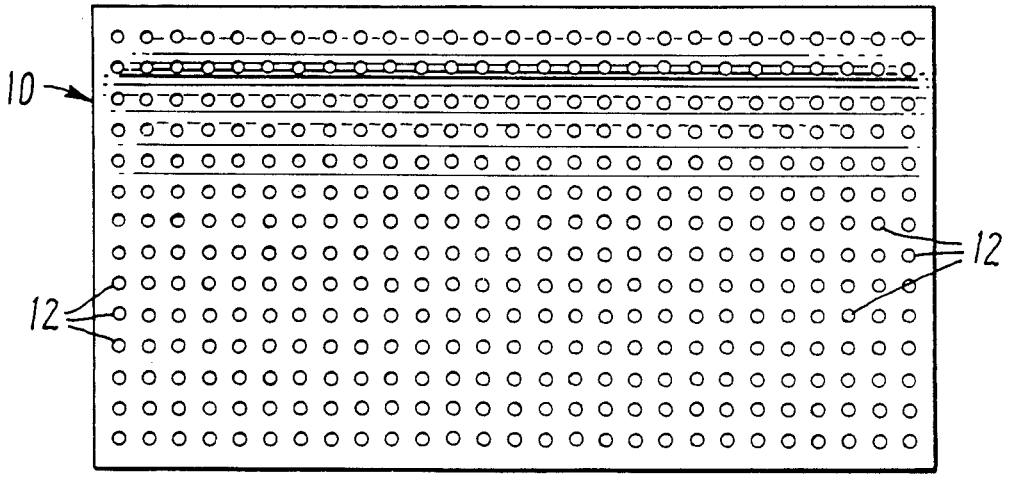

A more complete understanding of the invention can be had by reference to the accompanying drawings, wherein:

FIG. 1 is a view in perspective of the assembled fireplace grate showing the concave grate, the supports therefore, the assembled logs ready for burning and the multiple apertures through which the flow of air for promoting combustion is intended to pass; and FIG. 2 is a sectional view across the line II—II of FIG. 1 looking in the direction of the arrows; and FIG. 3 is a top plan view of the sheet of the invention showing the apertures as they are spaced on the sheet.

As can be seen from the drawings, the invention comprises a flat mild steel sheet 10 which in useful embodiments may be 16, 18 or 20 gauge steel. The shape of the sheet 10 in its preferred form is rectangular to conform to the contour of conventional fireplaces and the thickness or gauge of the sheet is sufficient to provide the rigidity and strength to hold the logs thereon for burning and to last for an extended period with repeated use. Modified shapes of the rectangular sheet 10 can be employed such as those in the form of a parallelogram or the like. The shape must be sufficient to provide the surface area for retaining the logs and to providing logs apertures beneath the logs to enable the air to pass through the sheet to accomplish the purposes of the invention and hence the term rectangular as used herein should be so construed.

Sheet 10 has a plurality of apertures 12 which extend through the sheet at approximately equal distances from each other throughout the entire area thereof. Good results are obtained when all such apertures on a given sheet are of the same diameter such as ¼ inch, 5/16 inch, ⅜ inch, or ½ inch in diameter and are equally spaced about one-inch apart. In fact, 31/32 inch centers are very useful spacing. To assure the uniform flow of air through the grate, the distances should be the same on each plate.

As will be noted by reference to the drawings, particularly FIG. 2, plate 10 has a generally concave configuration or shape along its length. The concave shape holds the logs L or other fuel to be burned in the fireplace so that it is conveniently retained and positioned for maximum burning efficiency.

In a typical installation of the invention, the sheet 10 is a rectangular sheet of about 30 inches in length and 16 inches in width. The concave shape that is given to it gives it a depth of about 1½ inches at the lowest point from the long edges of the sheet as will be seen by reference to FIG. 2. A natural flow or draft of air results by virtue of the resultant equal distribution of oxygen through the uniformly spaced apertures or draft control units and thus produces the maximum amount of thermal energy in the fireplace.

As previously described, the sheet or liner 10 sits on top of the grate 14 and retains the embers directly under the logs or other fuel on the liner or sheet instead of under the grate. As a matter of fact, the upper surface of the concave liner 10 may be burred to better engage and position the wood logs or like fuel. Grate 14 is of conventional design and comprises horizontal cross bars 16 and vertical support legs 18 at the corners of grate 14 and at spaced points along the length thereof. The retained embers act as part of a positive thermal promoter or enhancer that is activated by the flow of air through the multiple apertures or draft control units shown in FIGS. 1, 2 and 3. The effect is to provide a more thoroughly controlled combustion of fuel and a high energy fire while using minimum fuel.

Each draft control unit or aperture functions as an individual air flow unit because the draw of air or draft has greater control as it passes through the liner, which is not the case in conventional fireplace units. In contrast in a conventional firebox, the draft is an uncontrolled volume of air flowing over the fire and upward, causing the exit of the greater portion of thermal energy through the chimney. With the liner or sheet of the present invention, the more efficient overall performance of the fireplace results because of the combined control of the natural elements of the fireplace design and the radiation of thermal energy in the area to be heated.

In a preferred form of the invention, the percentage of air space provided by the apertures or draft control units to solid space on the surface of the plate or sheet 10 is approximately 9 to 1, that is 90% solid space to 10% air space. In a typical installation utilizing such preferred ratio, the liner or plate 10 is about 30 inches in length and 16 inches in width, thus providing a surface area of approximately 480 square inches, having 435 apertures or perforations of about ⅜ inch diameter. The thickness of the sheet or liner does not affect the percentage of air space to solid space (or surface area) so long as the sheet or plate 10 is sufficient to hold the log fuel during burning. Also, the apertures, or perforations, through the plate are of uniform diameter along their length, which arrangement facilitates the even flow of air and combustion gases and the like, and inhibits clogging of the apertures as occurs in the prior art.

The range of practical operating aperture area to total surface area on the plate 10 may range from about 4.45% to about 18% It is clear that the logs will burn notwithstanding the area of apertures to solid surface area of the plate. However, the advantages of the invention are lost if the open aperture area exceeds 18% so that the draft control effect provided by the apertures is lost because it is approaching the operation of an open screen while at the other end of the operative range, the amount of air passing through an arrangement of relatively few apertures or a restricted aperture area, is too small to have a effect on the efficiency of the burning of the logs. Accordingly, the practical range is from a minimum of about 5% perforation area to about 95% flat surface area upward to a maximum of about 18% perforation area to about 82% flat surface area. In all instances the strength of the plate is such that it will withstand continued use in the fireplace.

The plate 10 of the invention is thus a multi-purpose firegrate liner that saves firegrate burnout and fuel and inhibits the greater percentage of the emissions of particulates and pollutants. It can be relied on to resist heat greater than 2800° F. and other general deteriorating effects for better than four years. In its preferred form, it has been structurally designed to maintain its shape with better than 75 pounds of fuel in a single load without sagging.

A significant feature in the liner of the invention is that its structural design allows only a minute amount of heat to radiate below the fire area. The other prior art grate liners do not do this. In a conventional fireplace half of the heat is radiated below the fire area. However, in the present invention, the depth effect of the concave surface of the liner and the draft control units combine to create this radiation effect.

The unique draft control units or perforations, permit constant direction of the primary air flow or draft, inward and upward through the perforations into the fire area. At the same time the concave surface of the liner absorbs the heat of the live hot embers without melting. The liner then radiates this heat back into the fuel area causing a double thermal source and assists in preventing burning of the firegate.

The design of the draft control units does not cause any radical effect on the flames. However, it does create a hurriconal effect within the flames which thus maintain the hotter heat of the embers for a longer period within the fuel area and thereby inhibiting a large percentage, in some cases on the order of ninety (90) percent, of the particulates and pollutants before they can exit the chimney. The grate liners of the prior art do not perform this function.

The completeness of the burn in the final stage of the fire reduces the last of the embers to a fine powder/ash state with only a handful of small charcoals remaining. Such completeness of the burn on the liner 10 is indicative of the extent to which it serves as a fuel saver, which is further evidenced by the fact that the remaining charcoals may be retained upon the liner to be used to restart the next fire with only a very small amount of kindling. In a typical installation the amount of wood used in the winter months is reduced by about 18% compared to the amount used without the liner.

Having thus described the invention, what is claimed is:

1. A fireplace grate liner for enhancing the combustion of wooden logs and like fuel intended for burning on a fireplace grate consisting:

a single sheet of mild steel having a thickness sufficient to impart rigidity thereto, and length and width of generally rectangular shape approximating the upper surface of a fireplace grate, operable to be supported by that upper surface of a fireplace grate, said sheet having an upward face of concave shape along the length thereof, said upward face being substantially free of protrusions;

said steel sheet having draft control means for directing airflow through said steel sheet, said draft control means defined by a plurality of uniformly spaced apertures extending through the thickness and entirely placed within the outer edges thereof;

each of said apertures being of uniform diameter and providing even flow of combustion gases through steel sheet to insure efficient burning of said fuel;

and said steel sheet having a ratio of a top surface area of solid metal to open surface area, as provided by said apertures, ranging from about 5 percent perforated area and 95 percent solid surface area to about 18 percent perforated area and 82 percent solid surface area.

2. The fireplace grate liner of claim 1 wherein the mild steel sheet has a thickness within the range of 0.0375 to 0.0625 inches.

3. The fireplace grate liner of claim 1 wherein the apertures are set on about one-inch centers.

4. The fireplace grate liner of claim 1 wherein the apertures range in diameter from about $\frac{1}{4}$ to about $\frac{1}{2}$ inch.

* * * * *